United States Patent [19]

Shalaty

[11] 4,141,325

[45] Feb. 27, 1979

[54] VALVE ROTATOR

[75] Inventor: John H. Shalaty, Wickliffe, Ohio

[73] Assignee: TRW Inc., Cleveland, Ohio

[21] Appl. No.: 754,074

[22] Filed: Dec. 23, 1976

[51] Int. Cl.[2] ..... F01L 1/32

[52] U.S. Cl. ..... 123/90.3

[58] Field of Search ..... 123/90.28, 90.29, 90.3; 137/331

[56] References Cited

U.S. PATENT DOCUMENTS

| | | | |
|---|---|---|---|
| 2,582,060 | 1/1952 | Newton | 123/90.3 |
| 2,662,511 | 12/1953 | Sward | 123/90.3 |
| 2,775,232 | 12/1956 | Witzky | 123/90.3 X |
| 2,875,740 | 3/1959 | Leake | 123/90.3 |
| 3,710,768 | 1/1973 | May | 123/90.3 |
| 3,890,943 | 6/1975 | Schonlav | 123/90.3 |
| 3,952,713 | 4/1976 | Tauschek | 123/90.3 |

*Primary Examiner*—Robert G. Nilson

[57] ABSTRACT

A valve is reciprocable between opened and closed positions along a longitudinal axis and is rotatable about the axis by a rotator mechanism. The rotator mechanism includes first and second parts movable axially and rotatably relative to one another along and about the longitudinal axis. A plurality of shiftable ball elements are located between the first and second parts and are movable along predetermined paths for imparting relative rotation between the parts during relative axial movement therebetween. Each ball is constrained for movement along its predetermined path by surfaces which define a pocket in one member and in which the ball is located. Each of the pockets have a ramp along which the ball moves upon relative axial movement of the parts. A spring biases the ball to one end of the ramp and the ball moves toward the other end of the ramp when the first and second parts move axially towards each other. The ramp is defined by a plurality of surface portions which extend at different angles to a plane extending perpendicular to the longitudinal axis. The surface portion adjacent the one end of the ramp to which the ball is biased extends at the greatest angle to the plane and the angle at which the other surface portions extend to the plane are progressively less as the ramp progresses toward the other end of the pocket.

9 Claims, 8 Drawing Figures

VALVE ROTATOR

BACKGROUND AND SUMMARY OF THE INVENTION

This invention relates to the art of motion converting mechanisms, and more particularly to mechanisms for converting axial movement into rotational movement. Specifically, the present invention relates to a rotator mechanism for use in rotating a valve of an internal combustion engine and will be particularly described with reference thereto.

Rotators for rotating valves of an internal combustion engine are known. Such valve rotators include first and second parts which are mounted for movement relative to one another axially and rotatably along and about a longitudinal axis. One part has pockets in which balls are positioned for imparting relative rotation to the parts in response to relative axial movement of the parts. The pockets define a predetermined path along which the balls move. Specifically, the balls move along an inclined ramp which forms the bottom of the pocket. Numerous patents and other publications disclose rotators such as noted above and typical of such are U.S. Pat. Nos. 3,710,768 and 3,890,943.

In such rotators, the ramp along which the ball moves extends at a single angle to a plane extending perpendicular to the longitudinal axis of the valve, which axis is also the axis about which relative rotation occurs of the first and second parts of the rotator. The magnitude of the single ramp angle is determined usually as a compromise based on design consideration. A shallow single ramp angle provides for a greater load capacity and greater rotational movement of the valve for a given amount of axial movement of the balls as measured along the longitudinal axis of the valve stem. A steep single ramp angle allows the balls to roll more easily but less load capacity and rotational movement are provided for a given amount of axial movement of the balls as measured along the longitudinal axis of the valve stem.

In the single ramp angle designs the axial force which is required to move the ball from its starting position down the ramp for a given amount of axial movement of the ball remains the same throughout the extent of action of the rotator. Further, the amount of angular rotation for a given amount of axial ball movement also remains the same during the action of the rotator. Also, the single ramp angle rotators have suffered from sliding action between the ball and its contacting surfaces, and of course, any sliding reduces the life of the rotator.

The present invention is directed to a rotator design which enables greater efficiency and durability to be achieved and also provides the advantages of design flexibility as compared to the single ramp angle design.

The present invention specifically provides for a valve rotator of the above-noted construction where the ramp along which a ball moves is formed at plural angles. Specifically, the ramp along which the ball moves is formed of a plurality of surface portions which extend at different angles to a plane extending perpendicular to the longitudinal axis of the valve. A surface portion adjacent the end of the ramp at which the ball is located prior to axial movement of the parts of the rotator toward each other is at the greatest angle to the plane which extends perpendicular to the longitudinal axis of the valve. The angle at which the other surface portions of the ramp extend to the plane perpendicular to the longitudinal axis of the valve becomes progressively less as the ramp progresses toward the other end thereof. In other words, the order of angles used in a particular pocket is from steep to shallow as the ball rolls down the ramp.

As a result of this construction and due to the fact that the steeper angle is located at the end of the ramp where the ball begins its action, less vertical force on the ball is required to start the rolling motion of the ball. Increased rolling of the ball produces increased rotation and less sliding of the ball relative its adjacent surfaces. As a result, due to the fact that less sliding between the ball and its contacting surfaces occurs, the life of the device of the present invention is improved.

Further, the present invention provides a substantial advantage in increased design flexibility. Because of the multiple angle raceway ramp, a more precise rotator design can be effected for a given application. Specifically, because of the multiple ramp angle design, the vertical force required to move the ball down the ramp for an amount of axial ball movement will increase with each decrease in ramp angle and further the amount of angular rotation of the valve for an amount of axial ball movement will increase with each change in ramp angle.

U.S. Pat. No. 2,875,740 was uncovered as a result of a patentability study and search relative to the subject disclosure. The U.S. Pat. No. 2,875,740 does not operate on the principle of the subject disclosure. This patent is a lash adjuster rather than a rotator. Further, the balls in this patent are not constrained to move in a particular predetermined path defined by surfaces of a pocket in which the balls are located in accordance with the present invention.

BRIEF DESCRIPTION OF THE DRAWINGS

Further features of the present invention will be apparent to those skilled in the art to which it relates from the following detailed description made with reference to the accompanying drawings in which.

DESCRIPTION OF PREFERRED EMBODIMENT

As noted hereinabove, the present invention relates to a rotator mechanism and particularly a rotator mechanism for rotating a valve of an internal combustion engine about the longitudinal axis of the valve. Such rotator mechanism is well known and the present invention may be applied to a variety of different specific rotator constructions. As representative of the present invention, FIG. 1 illustrates a specific rotator construction embodying the present invention.

Figure 1:
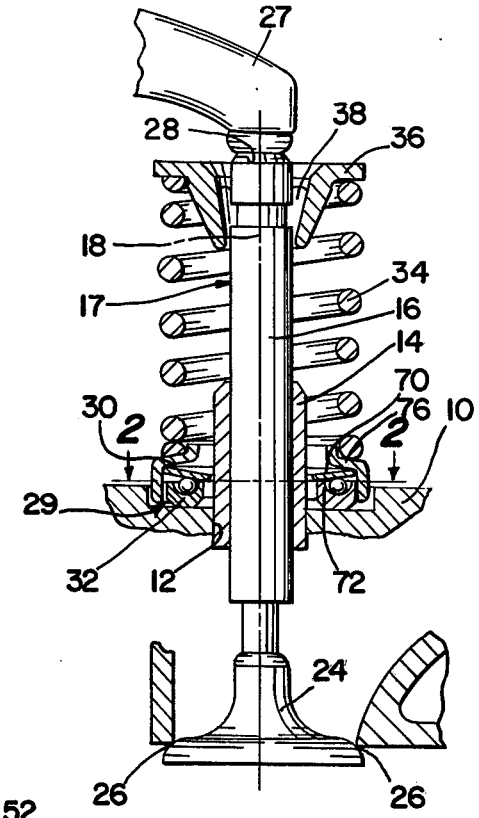
FIG. 1 is a cross sectional view of a valve rotator embodying the present invention.
Figure 2:
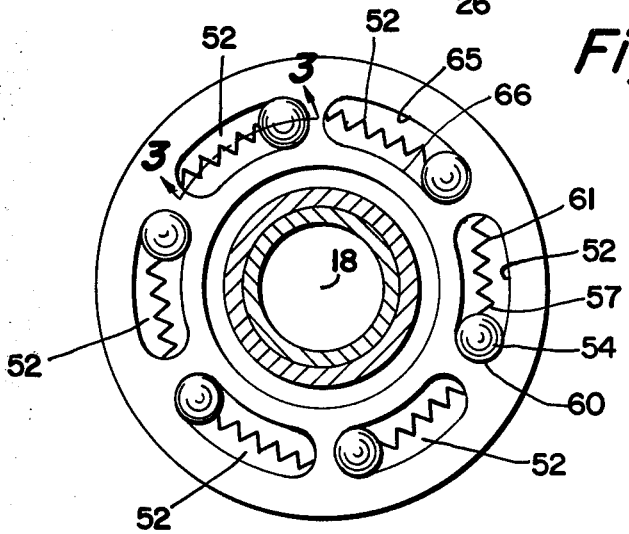
FIG. 2 is a view taken approximately along the line 2—2 of FIG. 1 but on an enlarged scale and with parts omitted.

As shown in FIG. 1, an engine cylinder head 10 has a bore 12 therethrough which receives a cylindrical valve quide sleeve 14. The stem 16 of a valve 17 for the internal combustion engine extends through the sleeve 14. The valve stem 16 may reciprocate in the guide sleeve 14 and also rotate about its longitudinal axis 18 within the sleeve 14. The valve 17 has a valve head 24 which moves between opened and closed positions relative to a valve seat 26 upon reciprocating movement of the valve 17. The valve 17 moves along its longitudinal axis 18 between the opened and closed positions relative to the valve seat 26 upon action by a suitable rocker arm 27 which engages the upper end 28 of the valve 17 and moves the valve 17 along its longitudinal axis 18.

As the valve reciprocates along its longitudinal axis 18 it is rotated about its longitudinal axis 18 by a valve rotator generally designated 29. The valve rotator 29 includes a first part 30 and a second part 32 which are positioned in encircling relation to the guide sleeve 14. The rotator part 32 bears against the upper surface of the cylinder head 10. A coiled valve spring 34 acts between the valve rotator part 30 and a valve spring retainer 36 located at the upper end of the valve stem 16. The spring retainer 36 is locked to the stem 16 against axial and rotational movement relative thereto by a locking member 38. It should be clear that as the rocker arm 27 moves downwardly, the spring 34 is compressed and the valve 24 moves to its open position. On movement of the rocker arm 27 upwardly as viewed in FIG. 1, the spring 34 will return the valve 24 to its closed position against the valve seat 26. The valve spring 34 comprises a variable force applying means for applying variable forces to the valve which forces alternately increase and decrease between minimum and maximum force values as the valve 24 is moved between its opened and closed positions.

In the valve closed position illustrated in FIG. 1, the valve spring 34 is expanded to its greatest extent and is applying a minimum force. As the rocker arm 27 moves downwardly to move the valve away from the valve seat 26, the force of the valve spring 34 gradually increases until its maximum force value is reached when valve 17 is fully opened. The forces of the valve spring 34 also act against the rotator part 30 for biasing the rotator part 30 axially towards the second rotator part 32, and firmly urges the second rotator part 32 into engagement with the outer surface of the cylinder head 10 so that the second part 32 is fixed against rotation.

The first and second rotator parts 30 and 32 are mounted for free movement rotatably and axially relative to one another about the longitudinal axis 18 of the valve 17. The parts 30 and 32 are shown generally in their maximum axially separated position in FIG. 1.

Figure 3:
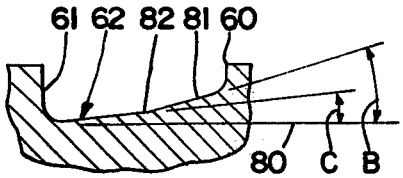
FIG. 3 is a view taken approximately along the line 3—3 of FIG. 2.

The second rotator part 32 has a plurality of individual and separate pockets 52 which receive shiftable elements in the form of balls 54. The pockets 52 define predetermined paths along which the balls 54 move. Each pocket 52 has one ball located therein. A spring 57 is also located in each pocket and engages the ball 54 and biases the ball towards one end 60 of its respective pocket. Each pocket 52 has a shallow end which is the end 60 and a deeper end 61 which is opposite from the end 60. The bottom of each pocket as best shown in FIG. 3 is inclined downwardly from the shallow end 60 toward the deeper end 61 to in effect define an inclined ramp 62. The balls 54 have a diameter substantially greater than the depth of the shallow end 60 of the pocket.

It should be noted further that in the embodiment illustrated in FIG. 1 of the drawings, the pockets 52 are circumferentially spaced around the member 32 and are curved. Each pocket is defined by an outer axially extending surface 65 and an inner axially extending surface 66 which surfaces are concentric with the axis 18. The surfaces 65 and 66 are spaced radially apart so as to constrain the balls 54 for movement along a predetermined path which path consists of the center line of the pocket 52. The surfaces 65, 66 restrict any movement transverse to that center line since these surfaces are radially spaced apart by a distance substantially equal to the diameter of the ball 54 located therebetween.

A Belleville spring washer 70 is positioned between the rotator parts 30 and 32 and applies a separating force to such parts tending to move the same axially away from each other. The separating force applied by the spring washer 70 has a magnitude intermediate the minimum valve closed force applied by valve spring 34 and the maximum valve open force applied thereby. In the closing position of the valve the inner bottom edge 72 of the spring washer 70 bears against an upper surface on the rotator part 32, and upper outer surface 76 of the spring washer bears against a surface of rotator part 30.

When the rocker arm 27 moves downwardly to move the valve head 24 away from the seat 26 the force of spring 34 increases so that the force applied by the first rotator part 30 against upper outer portion 76 of the spring washer 70 causes the inner bottom surface 72 of the spring washer to move upwardly away from the second rotator part 32 to free the first rotator part 30 and spring washer 70 for rotation relative to the second rotator part 32. The shiftable elements defined, namely the balls 54, then roll down ramp 62. During such rolling movement of the balls 54, the firm engagement between the balls and the spring washer 70 and the firm engagement between the portion 76 of the spring washer 70 and the first rotator part 30 cause the first rotator part 30 to rotate relative to the second rotator part 32. Due to the firm frictional engagement of valve spring 34 with the first rotator part 30 and spring retainer 36 this rotational movement is also imparted to the valve 17 and effects rotation of the valve about its longitudinal axis 18 during opening movement of the valve.

As the rocker arm 27 moves upwardly which allows the valve 24 to return to its closed position against the valve seat 26, the inner bottom portion 72 of the spring washer 70 again engages a surface portion of the second rotator part 32 to prevent reverse relative rotation between the first and second rotator parts 30 and 32. The action of the spring washer 70 and separating parts 30 and 32 as the force of the valve spring 34 decreases from its maximum towards its minimum value also allows the balls 54 to move back towards the shallow end 60 of the pocket 52 under the force of coil spring 57. This repetitive action successively rotates the valve for minimizing deterioration wear and stress upon the valve and the valve seat 26.

Figure 7:
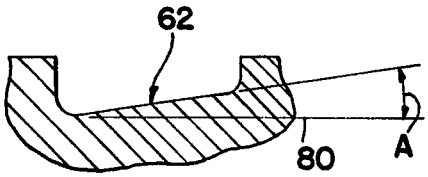
Fig. 7 PRIOR ART
FIG. 7 is a view similar to FIG. 3 but illustrating the pocket of a conventional known valve rotator.

Conventionally the bottom of the pockets 52 or ramp 62 has been formed at a single angle. This is best shown in FIG. 7 where the ramp 62 is shown as extending at a single angle A relative to a plane 80 which extends perpendicular to the longitudinal axis 18 of the valve 17. This angle usually in known constructions is formed at a magnitude which is at a compromise. A shallow angle gives a greater load capacity and greater rotational movement to the valve 17 for a given amount of vertical displacement of a ball 54. A steeper angle allows the balls 54 to roll more easily but less load capacity and rotational movement is effected.

Figure 4:
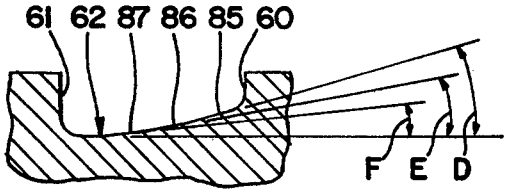
FIGS. 4 and 5 are views similar to FIG. 3 but illustrating different ramp angle constructions that could be utilized in the embodiment of FIG. 3.
Figure 5:
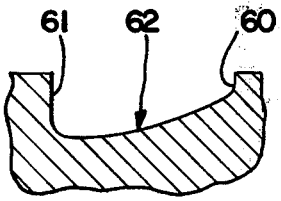

In accordance with the present invention, and as best shown in FIGS. 3, 4, and 5, the bottom surface 62 or ramp down which a ball 54 moves is designed in such a way that surface portions forming the ramp 62 extend at different angles to the plane 80 which extends perpendicular to the longitudinal axis 18 of the valve 17. As shown in FIG. 3, the ramp 62 is defined by surface portions 81 and 82. The surface portion 81 is located at the end 60 of the pocket 56, whereas the surface 82 extends from the surface portion 81 downwardly and toward the end 61 of the pocket. The surface portion 81 is formed at an angle B to the plane 80 which extends perpendicular of the axis 18 of the valve stem. The surface portion 82 extends at an angle C to the plane 80.

As shown in FIG. 4, the ramp 62 of the pocket 52 shown in FIG. 4 is formed of three surface portions designated 85, 86 and 87. These surface portions extend at angles D, E and F, respectively relative to the plane 80 which extends perpendicular to the axis 18 of the valve stem. FIG. 5 shows still a further multiple angle ramp 62 and in fact the ramp shown in FIG. 5 is a curvilinear surface and is thus in effect made up of a plurality or infinite number of surfaces at different angles.

It should be clear that the ramp designs shown in FIGS. 3, 4 and 5 can be utilized in the rotator of FIG. 1. It should further be clear that in each of the designs shown in FIGS. 3, 4 and 5, the steepest angle or greatest angle is located at the end 60 of the rotator pocket, namely the end to which the ball 54 is biased by the spring 57. As a result of the steeper angle being at the end 60, less vertical force is required on the ball 54 to start the ball 54 in rolling motion as compared to a design such as shown in FIG. 7 where a relatively shallow angle is at the end of the pocket. As a result, increased rolling action is produced during the initial movement of the ball 54 and as a result of increased rolling action, there is a minimization of sliding action and this increases the life of the rotating device as compared to the device of FIG. 7.

Further, the designs illustrated in FIGS. 3, 4 and 5 provide substantial advantages in terms of design flexibility as compared to the prior art such as illustrated by the design of FIG. 7. As is known in such devices of the present type, the vertical force required to move the ball 54 down the ramp 62 increases with a decrease in ramp angle. Further the amount of angular rotation of the valve stem 16 for each amount of vertical movement of the ball 54 will increase with each decrease in ramp angle. These characteristics of operation of valve rotators are graphically illustrated in FIG. 8 where a comparison of the embodiments illustrated in FIGS. 4 and 5 are made with the prior art which is shown in FIG. 7.

Figure 8:
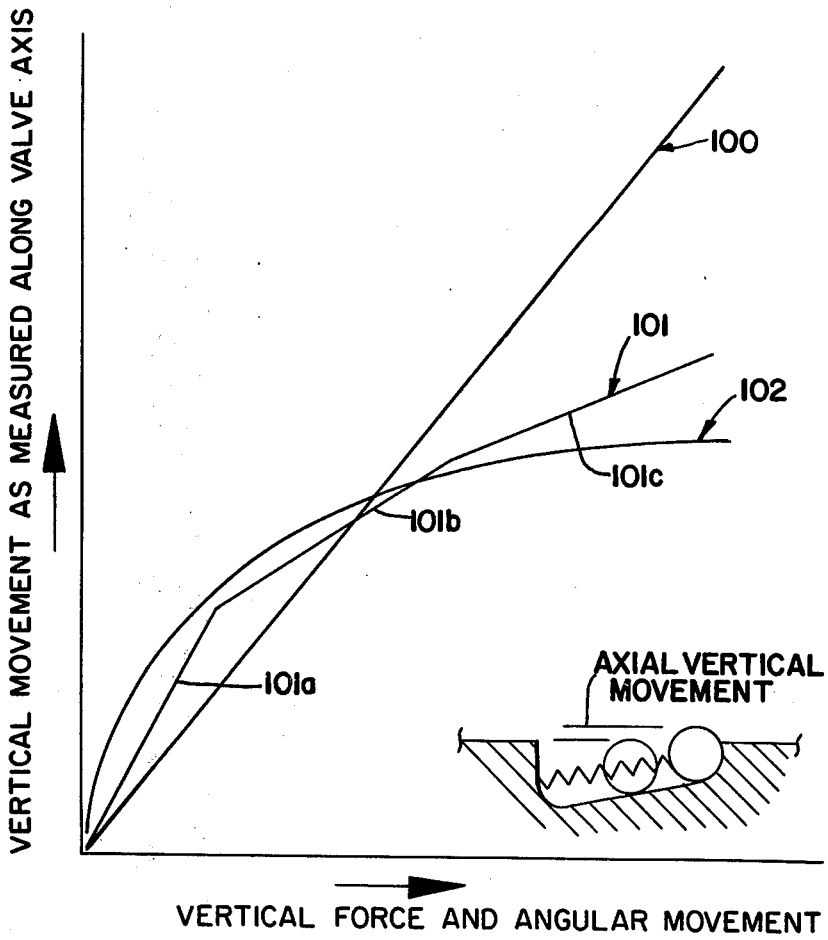
FIG. 8 is a graph illustrating the operational characteristics of valve rotators embodying the present invention and the prior art.

As illustrated in FIG. 8, the vertical force and angular movement plotted along the horizontal, and vertical movement of the ball as measured along the longitudinal axis of the valve is plotted along the vertical. The curve designated 100 is a straight line and illustrates the operation of a single ramp angle rotator. It should be clear that in a single angle ramp for each amount of vertical deflection of the ball 54 a given amount of angular movement of the valve is provided.

The curve 101 in FIG. 8 illustrates a three angle ramp construction as shown in FIG. 4. The curve 101 has three portions 101*a*, 101*b* and 101*c*. These portions indicate the amount of angular movement of the valve versus the vertical movement of the ball as the ball moves along the surface portions 85, 86 and 87 of the embodiment of FIG. 4. The curve portion 101*a* corresponds to the movement that occurs when the ball moves along the surface portion 85. Curves 101*b* and 101*c* correspond to the movement of the ball along the surface portions 86 and 87, respectively.

The curve 102 in FIG. 8 is a graphic representation of the operation of a rotator embodying the present invention in which the ramp 62 is formed of an infinite number of surfaces at different angles, as illustrated in FIG. 5. As illustrated therein, the angular movement of the valve stem for an amount of vertical deflection of the ball 54 varies considerably and is in effect a non-linear function.

From the above, it should be apparent that the valve rotator embodying the present invention has substantial advantages and that the valve rotator can be embodied in a number of different structural embodiments. It should be apparent that combinations of the various multiple ramp angle pockets could be provided in a rotator and that multiple angle ramp pockets could be utilized in the same rotator with single ramp angle pockets to obtain the desired functional and operational characteristics for a given application.

Figure 6:
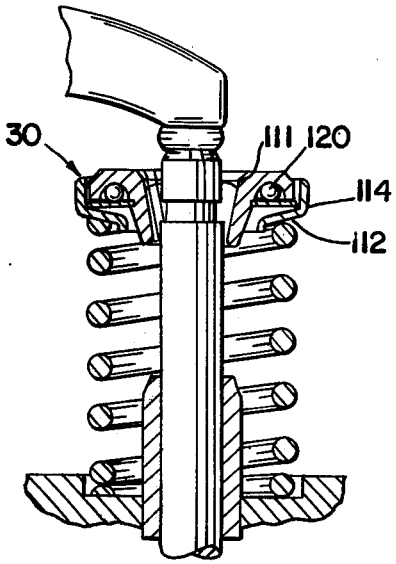
FIG. 6 is an axial sectional view of a modified valve rotator construction embodying the present invention.

It should further be apparent that the particular rotator structure shown in FIG. 1 is merely one application of a design where the present invention may be utilized. FIG. 6 shows another typical valve rotator design in which the present invention may be utilized.

As shown in FIG. 6, the valve rotator 30 is mounted at the upper end of the valve stem. This design is a conventional design and will not be described herein in detail. However, it should be noted that the valve rotator 30 includes rotator parts 111 and 112 and a spring washer 114 acts between the parts 111 and 112 and against the balls 120. The balls 120 in the embodiment of FIG. 6 are located in pockets which are constructed in a manner as illustrated in FIGS. 3, 4 or 5.

Having described my invention, I claim:

1. A rotator for a valve which is reciprocable between opened and closed positions along a longitudinal axis and is rotatable about said axis, said rotator including first and second parts movable axially and rotatably relative to one another along and about said axis, variable force applying means for urging said valve towards said closed position and urging said parts toward one another with forces which alternately increase and decrease, means for imparting relative rotation to said first and second parts in a first direction and of a first angular magnitude upon axial movement toward each other and for restricting relative rotation in a direction opposite to said first direction to a second angular magnitude of said parts upon axial movement away from each other, said second angular magnitude being less than said first angular magnitude to yield a net positive rotation in said first direction, said means including a plurality of shiftable balls between said parts movable along predetermined separate paths for imparting said relative rotation thereto, means defining pockets in one of said parts for receiving a respective ball and for constraining said respective ball to move in its predetermined separate path, each of said pockets having a ramp along which the ball moves upon relative axial movement of said part, means biasing the ball to one end of the ramp, the ball moving toward the other end of the ramp when said first and second parts move axially toward each other, at least one of the ramps being defined by a plurality of surface portions which extend at different angles to a plane extending perpendicular to said longitudinal axis, the surface portion adjacent said one end of said ramp extending at the greatest angle to said plane and the angle at which any other surface portions extend to said plane being progressively less as said ramp progresses toward the other end thereof.

2. A valve rotator as defined in claim 1 wherein said ramp is defined by an infinite number of surface portions and thus has a curvilinear surface.

3. A rotator as defined in claim 1 in which each of said pockets have a ramp, each of the ramps being defined by a plurality of surface portions which extend at different angles to a plane extending perpendicular to said longitudinal axis.

4. A rotator for a valve which is reciprocable between opened and closed positions along a longitudinal axis and is rotatable about said axis, said rotator including first and second parts movable axially and rotatably relative to one another along and about said axis, variable force applying means for urging said valve toward said closed position and urging said parts toward one another with forces which alternately increase and decrease, means for imparting relative rotation to said first and second parts in a first direction and of a first angular magnitude upon axial movement toward each other and for restricting relative rotation of said parts in a direction opposite to said first direction to a second angular magnitude upon axial movement away from each other, said second angular magnitude being less than the first angular magnitude to yield a net positive rotation in said first direction, and means including a plurality of shiftable balls between said parts movable along predetermined separate paths for imparting said relative rotation thereto, means defining pockets in one of said parts for receiving a respective ball and for constraining said respective ball to move in its predetermined separate path, each of said pockets having a ramp along which the ball moves upon relative axial movement of said part, means biasing the ball to one end of the ramp, the ball moving toward the other end of the ramp when said first and second parts move axially toward each other, at least one of the ramps being defined by a plurality of surface portions which extend at different angles to a plane extending perpendicular to said longitudinal axis, the surface portion adjacent said one end of said ramp extending at the greatest angle to said plane and the angle at which any other surface portions extend to said plane being progressively less as said ramp progresses toward the other end thereof, said relative rotation imparting means further including a Belleville spring member located between said parts and in contact with said balls.

5. A rotator for a valve which is reciprocable between opened and closed positions along a longitudinal axis and is rotatable about said axis, said rotator including first and second parts movable axially and rotatably relative to one another along and about said axis, variable force applying means for urging said valve toward said closed position and urging said parts toward one another with forces which alternately increase and decrease, means for imparting relative rotation to said first and second parts in a first direction and of a first angular magnitude upon axial movement toward each other and for restricting relative rotation of said parts in a direction opposite to said first direction to a second angular magnitude upon axial movement away from each other, said second angular magnitude being less than the first angular magnitude to yield a net positive rotation in said first direction, said means including a plurality of shiftable balls between said parts movable along predetermined separate paths for imparting said relative rotation thereto, means defining pockets in one of said parts for receiving a respective ball and for constraining said respective ball to move in a predetermined separate path, each of said pockets having a ramp along which the ball moves upon relative axial movement of said parts, said pockets being defined by axially extending surfaces which are radially spaced a distance which relates to the diameter of the balls located in the pockets so that the balls are constrained to move along the center line of said pockets, means biasing the ball to one end of said ramp, the ball moving toward the other end of the ramp when said first and second parts move axially toward each other, at least one of the ramps being defined by a plurality of surface portions which extend at different angles to a plane extending perpendicular to said longitudinal axis, the surface portion adjacent said one end of said ramp extending at the greatest angle to said plane and the angle at which any other surface portions extend to said plane being progressively less as the ramp progresses to the other end thereof.

6. A rotator for a valve which is reciprocable between opened and closed positions along a longitudinal axis and is rotatable about said axis, said rotator including first and second parts movable axially and rotatably relative to one another along and about said axis, variable force applying means for urging said valve toward said closed position and urging said parts toward one another with forces which alternately increase and decrease, means for imparting relative rotation to said first and second parts in a first direction and of a first angular magnitude upon axial movement toward each other and for restricting relative rotation of said parts in a direction opposite to said first direction to a second angular magnitude upon axial movement away from each other, said second angular magnitude being less than said first angular magnitude to yield a net positive rotation in said first direction, said means including a plurality of shiftable balls between said parts movable along predetermined separate paths for imparting said relative rotation thereto, means defining pockets in one of said parts for receiving a respective ball and for constraining said respective ball to move in its predetermined separate path, each of said pockets having a ramp along which the ball moves upon relative axial movement of said parts, means biasing the ball to one end of the ramp, the ball moving toward the other end of the ramp when said first and second parts move axially toward each other, at least one of the ramps being defined by two or more flat surface portions which extend at different angles to the plane extending perpendicular to said longitudinal axis, the surface portion adjacent said one end of said ramp extending at the greatest angle to said plane and the angle at which any other surface portions extend to said plane being progressively less as the ramp progresses toward the other end thereof.

7. A rotator for a valve which is reciprocable between opened and closed positions along a longitudinal axis and is rotatable about said axis, said rotator including first and second parts movable axially and rotatably relative to one another along and about said axis, variable force applying means for urging said valve toward said closed position and urging said parts toward one another with forces which alternately increase and decrease, means for imparting relative rotation to said first and second parts in a first direction and of a first angular magnitude upon axial movement toward each other and for restricting relative rotation of said parts in a direction opposite to said first direction to a second angular magnitude upon axial movement away from each other, said second angular magnitude being less than said first angular magnitude to yield a net positive rotation in said first direction, said means including a plurality of shiftable balls between said parts movable along predetermined separate paths for imparting said relative rotation thereto, means defining pockets in one of said parts for receiving a respective ball and for constraining said respective ball to move in its predetermined separate path said pockets in said one of said parts being defined by axially extending surfaces which are radially spaced a distance which relates to the diameter of the balls located within the pockets so that the balls are constrained to move along the same centerline of said pockets, each of said pockets having a ramp along which the ball moves upon relative axial movement of said part, means biasing the ball to one end of the ramp, the ball moving toward the other end of the ramp when said first and second parts move axially toward each other, at least one of the ramps being defined by a plurality of surface portions which extend at different angles to a plane extending perpendicular to said longitudinal axis, the surface portion adjacent said one end of said ramp extending at the greatest angle to said plane and the angle at which any other surface portions extend to said plane being progressively less as said ramp progresses to the other end thereof, said relative rotation imparting means further including a Belleville spring member located between said parts and in contact with said balls.

8. A rotator for a valve which is reciprocable between opened and closed positions along a longitudinal axis and is rotatable about said axis, said apparatus including first and second parts movable axially and rotatably relative to one another along and about said axis, variable force applying means for urging said valve toward said closed position and urging said parts toward one another with forces which alternately increase and decrease, means for imparting relative rotation to said first and second parts in a first direction and of a first angular magnitude upon axial movement toward each other and for restricting relative rotation of said parts in a direction opposite to said first direction to a second angular magnitude upon axial movement away from each other, said second angular magnitude being less than said first angular magnitude to yield a net positive rotation in said first direction, said means including a plurality of shiftable elements between said parts movable along predetermined separate paths for imparting said relative rotation thereto, means defining pockets in one of said parts for receiving a respective element and for constraining said respective element to move in its predetermined separate path, each of said pockets in one of said parts being defined by axially extending surfaces which are radially spaced a distance which relates to the radial dimension of the element located within the pockets so that the element is constrained to move along the centerline of the pocket, at least one of said pockets having a ramp along which the element moves upon relative axial movement of said part, means biasing the element to one end of the ramp, the element moving toward the other end of the ramp when said first and second parts move axially toward each other, said ramp being defined by a plurality of surface portions which are engaged sequentially by said element as it moves along said ramp and which surface portions extend at different angles to the plane extending perpendicular to said longitudinal axis.

9. A rotator for a valve as defined in claim 8 wherein said shiftable elements comprise balls and wherein at least one of the ramps along which a ball element moves is defined by a plurality of surface portions which extend at different angles to a plane extending perpendicular to said longitudinal axis.

* * * * *